US007320355B2

(12) United States Patent
Skerdi et al.

(10) Patent No.: US 7,320,355 B2
(45) **Date of Patent: *Jan. 22, 2008**

(54) FEEDER WITH A TUBULAR BODY

(75) Inventors: Udo Skerdi, Bendorf (DE); Georg Scheerer, Waldmorh (DE)

(73) Assignee: AS Lungen GmbH & Co. KG, Bendorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/145,798

(22) Filed: Jun. 6, 2005

(65) Prior Publication Data

US 2006/0000574 A1 Jan. 5, 2006

Related U.S. Application Data

(63) Continuation-in-part of application No. 10/433,236, filed on Jul. 24, 2003, now Pat. No. 6,904,952.

(30) Foreign Application Priority Data

Nov. 30, 2000 (DE) ..... 100 59 481
Aug. 30, 2001 (DE) ..... 101 42 357

(51) Int. Cl.
*B22C 9/08* (2006.01)

(52) U.S. Cl. ..... 164/359; 164/360

(58) Field of Classification Search ..... 164/359, 164/360

See application file for complete search history.

(56) References Cited

U.S. PATENT DOCUMENTS

| | | | | |
|---|---|---|---|---|
| 4,025,047 | A * | 5/1977 | Takashima | 249/204 |
| 4,526,338 | A | 7/1985 | Reiland | |
| 6,904,952 | B2 * | 6/2005 | Skerdi et al. | 164/359 |
| 2003/0032701 | A1 * | 2/2003 | Gough | 523/218 |

FOREIGN PATENT DOCUMENTS

| | | |
|---|---|---|
| DE | 3500809 | 7/1985 |
| DE | 3614629 | 11/1987 |
| DE | 4200183 | 7/1992 |
| DE | 4119192 | 12/1992 |
| DE | 19503456 | 11/1995 |
| DE | 19642838 | 7/1997 |
| DE | 19925167 | 12/2000 |
| DE | 10039519 | 2/2002 |
| DE | 10059481 | 6/2002 |
| GB | 1464720 | * 2/1997 |

* cited by examiner

*Primary Examiner*—Kevin P. Kerns
(74) *Attorney, Agent, or Firm*—Scott R. Cox

(57) ABSTRACT

This present invention concerns a feeder system for a cast piece with a feeder and/or feeder head and a tubular body, characterized in that the tubular body connects the feeder and/or feeder head directly or indirectly with the cast piece and/or the mold cavity and wherein the tubular body is made of cardboard or steel having a high carbon content.

41 Claims, 6 Drawing Sheets

FEEDER WITH A TUBULAR BODY

CROSS REFERENCE TO RELATED APPLICATIONS

This application is a continuation-in-part application based on application Ser. No. 10/433,236, filed Jul. 24, 2003 now U.S. Pat. No. 6,904,952.

BACKGROUND AND DESCRIPTION

This present invention concerns a feeder system for a cast piece with a feeder (head) as well as a tubular body.

In the production of molded parts in foundries, liquid metal is filled into a casting mold. During the hardening process, the volume of the filling material is reduced. For that reason, so-called feeders, i.e. open or closed spaces in or on the casting mold, are commonly used to make up for the deficit in volume which occurs as the cast piece hardens and to prevent pipe formation in the cast piece. For that purpose, such feeders are connected with the cast piece and/or the respective section of the cast piece that is affected thereby and are usually located above and/or on the side of the mold cavity.

Several types of feeders are known from prior art. For example, DE 196 42 838 A1 describes a feeder for a metallic cast piece in the form of a bell with a retracted rim, wherein such rim is formed by a flat ring element attached thereto.

DE 41 19 192 A1 describes a spring-supported pin to secure feeders. The feeder inserts are placed on a pin connected with the casting mold and preferably molded into the cope box. Since the feeder material is very flexible and the sand pressure easily causes damage to the inserted feeder during the molding process in the molding system, it is known from prior art to provide the pin in a spring-supported, axially movable manner to allow the molded feeder to move away from the sand pressure in the direction towards the model.

Usually, the feeders are located approximately at the cutting height and, additionally, equipped with a heat-insulating material and/or an exothermic material in such a manner that the molten metal located in the feeder hardens later than the cast piece itself. After hardening, the feeder remains connected with the cast piece, as a result of which the remaining feeder needs to be separated afterwards. In many cases, cleanly and easily separating the feeder from the cast piece is problematic. As a general rule, after separating the feeder, the surface of the cast piece still needs to be deburred and smoothened. This is a complicated and, consequently, costly procedure which may also cause damage to the surface of the cast piece at its contact point with the feeder. To reduce such damage and facilitate the separation of the feeder, so-called breaking cores (also referred to as breaking edges) are frequently provided. They are installed between the feeder and the casting mold and require suitable contact surfaces.

Generally speaking, prior art feeders are either relatively complicated insofar as their construction and/or handling during the manufacture of casting molds is concerned and/or do not guarantee easy and precise separation of the remaining feeder from the cast piece, or they require a relatively large contact surface.

Based on the above, the object of this present invention is to provide a feeder system which overcomes the drawbacks of prior art devices and, in particular, has a simple construction, which can be easily secured to and/or molded onto the casting mold, and only requires small contact surfaces while, at the same time, permitting a precisely positioned breaking edge directly on the cast piece for easy and safe separation of the remaining feeder from the finished cast piece.

A further object of the invention is to provide a feeder system which reduces the problem of formation of shrinkage cavities or other defects, like gas inclusions, in the cast piece.

These objects are achieved by a feeder system in accordance with the invention. Preferred embodiments hereof are disclosed in the specification.

As used herein, the term "feeder" covers all types of feeders, feeder jackets, feeder inserts, and feeder caps as well as heating pads that are known from prior art or to those in the art.

As a basic rule, this present invention is suitable for all types of feeders containing a tubular body.

In particular, this present invention is suited for so-called minifeeders which are usually molded on by means of a breaking edge or by using a spring-supported pin.

The feeder system in accordance with this present invention comprises at least two parts. A first part is facing away from the cast piece and comprises a feeder or a feeder head, which comprises a cavity to receive liquid metal during the casting process. A second part, facing towards the cast piece is a tubular body which connects the cavity in the feeder head to the cast piece.

According to a first embodiment, the second piece is made from cardboard. It has been found that upon contact with the liquid metal cardboard starts burning. However, only low amounts of gaseous products or smoke are formed during said burning. The cardboard burns quite smoothly and therefore hardly any formation of gas inclusions are caused in the cast piece. As a further advantage, when pouring the liquid metal into the feeder, only a small amount of splashing of the liquid metal is caused, because of the relatively small amount of gas formed during the burning of the cardboard. When comparing tubular bodies made from cardboard to those made of plastic materials, a considerably higher amount of gas is formed upon contact of the liquid metal with the plastic materials and, as a consequence, much more splashing of liquid metal occurs, and therefore, more defects are formed in the cast piece.

The wall thickness of the cardboard tube is more than 0.5 mm, preferably more than 1 mm, most preferably more than 2 mm to provide sufficient stability for the feeder. A wall thickness of the tubular body of up to 10 mm is sufficient to provide reasonable mechanical stability for the feeder system.

The cardboard has a weight of at least about 200 g/m$^2$, preferably at least about 400 g/m$^2$, most preferably at least about 600 g/m$^2$.

Preferably, solid cardboard is used to form the tubular body, although it is also possible to form the tubular body from corrugated cardboard or other forms of cardboard known to those in the art.

In a second embodiment, the tubular body is formed from steel having a carbon content of at least about 0.7 wt.-%, preferably at least about 1.5 wt.-%. With increasing carbon content the steel becomes brittle and difficult to deform. Therefore, to obtain a reasonable deformability of the steel, the carbon content of the steel is chosen to be less than about 8 wt.-%, preferably less than about 5 wt.-%, especially preferred less than about 4 wt.-%. The overall range of carbon content of the steel is from about 0.7 to about 8 wt.-%, preferably about 1.5 to about 5 wt.-% and most preferred from about 1.5 to about 4 wt.-%.

Steel has a melting temperature higher than the melting temperature of cast iron. Therefore, when pouring the cast iron into the cavity of the casting mould, the steel does not liquefy immediately and thus, is not distributed throughout the whole casting piece. Rather, when the tubular body is made from steel, the steel only melts near the end of the casting process when liquid metal flows from the cavity of the feeder into the casting mold to compensate for shrinking of the casting piece during solidification and down-cooling. This especially occurs with use of exothermic feeders which heat up the liquid metal contained in the feeder cavity. Therefore, the liquefied steel concentrates in the cast piece only at or close to the exit of the feeder where it may dilute the cast iron. Conventionally, steel has a low carbon content and, therefore, the overall carbon content of the cast iron is reduced when mixed with the liquefied steel. This causes defects in the cast piece, such as formation of small cavities inside the cast piece. It now has been found that the amount of defects in the cast piece can be reduced by forming the tubular body of the feeder system from steel having a high carbon content. The carbon content of the steel should be as high as possible. Notwithstanding, steel becomes brittle with increasing content of carbon, thereby making it difficult to form the tubular body of the feeder system by drawing the steel. Therefore, the carbon content of the steel is chosen as high as possible, while still allowing deformation of the steel during production of the tubular body. Preferably, the carbon content of the steel is chosen to be less than 8 wt-%, preferably less than 5 wt-%, and an especially preferred content is less than 4 wt_% as discussed above.

The tubular body can be of any desired shape and, depending on the case, suitable length, wall thickness, and diameter. Depending on the material that is used, the wall thickness will usually range from 0.1 mm to 10 mm, in particular from 0.3 mm to 5 mm, particularly preferably from 0.3 mm to 0.5 mm. The optimal dimensions can be determined, on a case-by-case basis, through routine testing and/or are known to those in the art, based on their experience. The wall thickness also varies depending on the material used and may, in case steel sheet and a spring-supported pin-equipped minifeeder are used, be roughly 0.3 mm to 0.5 mm.

Usually, the tubular body has a length between approx. 15 and approx. 300 mm, in particular between approx. 35 and approx. 100 mm. In one embodiment of this present invention, the length of the tubular body is chosen such as to cover at least the distance between the feeder (prior to molding; optionally on the pin) and the cast piece.

As a general rule, the internal diameter of the tubular body can be chosen as desired; the opening should be large enough, however, to ensure the flow of the molten metal into and/or out of the feeder during the casting and hardening process. Usually, although not necessarily, the diameter of the tubular body depends on the internal diameter of the feeder, considering that, in accordance with one embodiment of this present invention, the tubular body is fitted and/or inserted into the feeder (head). However, the tubular body can also be connected with the feeder (head) in a different manner.

The tubular body may have any desired cross-sectional shape, in particular with a round, oval, rectangular or multiangular geometry.

In accordance with one embodiment of this present invention, the tubular body is a tube with a cross-section which essentially remains the same over its entire length. Preferably, the ratio between the wall thickness and the overall diameter of the tube is roughly between 1:2 and 1:200, in particular between 1:5 and 1:120, and particularly preferably between 1:10 and 1:100. The ratio between the length and the overall diameter of the tube is preferably between approx. 1:4 and 15:1, in particular between 1:1 and 6:1. In particular, the ratios are determined by the feeder and casting mold geometries.

The feeder and/or feeder head may be made of any prior-art insulating and/or exothermic material to ensure that the molten metal located in the feeder hardens after the cast piece itself. For example, the feeder may be manufactured from the exothermic feeder materials disclosed in DE 199 25 167, filed by this applicant, which is incorporated herein in its entirety by reference.

In a preferred embodiment of the present invention, the external circumference of the tubular body is in close contact with the feeder and/or feeder head, and preferably, the tubular body is connected thereto by using means that are known to those in the art, e.g. a glue, such as a hot glue or water glass, a wedge, or by means of a fitting. The tubular body may also be simply inserted into the feeder (head).

In another preferred embodiment of this present invention, however, the tubular body is movable with respect to the feeder and/or feeder head and/or the cast piece and/or the mold cavity, at least within certain limits. As a result, on one hand, a particularly uncomplicated connection of the feeder can be ensured, and on the other hand, optimal positioning of the breaking edge can be achieved due to the displacement between the feeder and/or tubular body and the cast piece which occurs during the molding-on process and/or densification of the molding material.

As a result of the densification of the molding material and the corresponding relative displacement between the feeder and/or tubular body and the cast piece and/or mold cavity, the distance between the tubular body and the cast piece can be easily adjusted prior to the molding process in such a manner that, after the molding-on process and/or densification of the molding material, the tubular body provides an optimally positioned breaking edge which is as close as possible to the finished cast piece.

In a preferred embodiment of this present invention, the tubular body narrows in the direction towards the cast piece and forms a breaking edge directly at the entrance to the casting mold and/or in the immediate vicinity thereof. In accordance with a preferred embodiment of this present invention, only a certain section, preferably a section facing the cast piece, may have a tapering or narrowing of the (internal) diameter. As a result, the tubular body serves, on one hand, to provide a feeder neck that can be molded on and, on the other hand, to provide a precise and firmly positioned breaking edge. Preferably, the breaking edge is a narrowing of the opening and/or internal diameter on or in the proximity of that end of the tubular body which faces the cast piece.

According to another preferred embodiment the narrowing of the tubular body is performed in a stepwise manner. In this embodiment, the tubular body is formed of several sections which surfaces are arranged to each other either in a rectangular or an inclined manner as shown, for example, in FIGS. 5, 6 and 7. If the surfaces of the individual sections are arranged relative to each other in a rectangular manner, the tubular body obtains a "staircase-like" form with stepwise decreasing diameter in a direction towards the end facing the cast piece of mold cavity as shown, for example, in FIG. 7. If the individual sections are arranged to each other in an inclined manner, the tubular body obtains a "harmonica-like" form as shown, for example, in FIGS. 5 and 6. In both embodiments, the tubular body may be deformed in a controlled manner during densification of the molding material by upsetting the tubular body. These embodiments of the narrowing of the tubular body can be produced either from cardboard or steel, as discussed above.

In another preferred embodiment of this present invention, however, the tubular body does not narrow in the direction towards the cast piece and/or does not have a narrowed section. It may be preferable to push the tubular body, e.g. an essentially cylindrical tube, onto a pin, in particular a spring-supported or guiding pin, until that end of the tubular body which faces the cast piece comes to rest on the leg of the pin in the vicinity of the cast piece. Between the tubular body and the (leg of the) pin, a small gap is formed. It has been shown that such a gap, together with the air inclusions in this area that form during the molding process, may also lead to the formation of an acceptable breaking edge. In addition, as explained in detail above, by properly sizing the tubular body, the position and shape of the breaking edge can be optimized, e.g. by using a relatively small tube with a small diameter or by properly positioning the feeder and/or feeder head in such a manner that, after the molding-on process and/or densification of the molding material, the feeder and/or feeder head is located in the vicinity of (although not directly on) the cast piece.

In a preferred embodiment hereof, the feeder system in accordance with this present invention, as mentioned above, furthermore comprises a pin, in particular a spring-supported pin.

The feeder connected with the tube (tubular body) is properly kept up by the spring-supported pin. The tube rests in an upright position on the mold and/or the beveled bottom of the spring-supported pin. During the molding process, the feeder is guided downwards over the tube into the corresponding end position by the spring-supported pin. The tube remains firmly in its original position. This ensures that a defined breaking edge is provided directly on the cast piece.

Within the scope of this present invention, any core, pin, or spring-support pin that appears suitable to those in the art may be used. Towards the cast piece, the tubular body may either completely project over the spring-supported pin or rest on its leg. In both cases, a connection between the mold cavity and the tubular body is provided (either directly or indirectly).

In accordance with another preferred embodiment hereof, the tubular body may be used as a spring-supported pin and/or guiding pin replacement. The feeder is guided over the tubular body resting on the casting mold in an upright position and centered, optionally by means of a permanently positioned pin, whose length may be different. Preferably, the permanently positioned pin is no longer than the tubular body. In many cases, however, it may be preferable that the permanently positioned pin be shorter than the tubular body, and the latter is pushed over the permanently positioned pin, at least partially. During the densification process, the feeder is then pushed over the tubular body. In a preferred embodiment in accordance with this present invention, in the upper section, the feeder is destroyed by the tubular body. The broken parts of the feeder are then embedded in the molding sand.

For each cast piece, the tubular body must be adjusted in such a manner that the distance between the feeder and the cast piece still ensures sufficient feeding. In many cases, this distance will be between 5 and 25 mm.

Towards the top, the tubular body may be open or closed.

In a preferred embodiment of this present invention, the tubular body may, in case it is open on the side facing away from the cast piece, be supported by a relatively long receiving pin. Preferably, in the upper section, the tubular body is perforated to ensure proper ignition of the feeder. Towards the cast piece, no holes and/or openings should be present in the tubular body, considering that this would lead to the penetration of molding sand during the molding-on process.

With respect to yet another embodiment of this present invention, it has been found that, in some cases, it may also be advisable, for easy handling, that the tubular body is not directly connected, prior to the molding-on process and/or densification of the molding material, with the cast piece and/or the mold cavity, or rests on the spring-supported pin (if any).

The feeder system can be designed in such a manner that the tubular body, during the molding-on process and/or the densification of the molding material, moves in the direction of the cast piece and/or mold cavity. In accordance with such embodiment, the tubular body has a relatively thin wall thickness, as a result of which the tubular body can cut through the same towards the cast piece during the molding-on process and/or the densification of the mold material. Additionally, this can be facilitated by providing the tubular body, on the end facing the cast piece, with some type of a cutting edge, by reducing the wall thickness of the tubular body in this area, or by making the wall of the tubular body particularly thin in this area.

Preferably, the feeder system is sized and positioned opposite the cast piece in such a manner that, once the spring path has been adjusted after the molding-on process and/or completed densification of the molding material on the tubular body, a defined breaking edge is formed between the feeder and the cast piece.

Preferably, to be able to properly move and/or cut through to the cast piece during the densification of the molding material, the tubular body itself has a relatively thin wall, which allows it to penetrate through the molding material to the cast piece and/or to the mold cavity. Preferably, the wall thickness of the tubular body is approx. 0.05 mm to 1 mm, in particular 0.2 to 0.5 mm, in case a solid material such as steel sheet is used. Of course, the wall of the tube must be sufficiently stable so as not to be destroyed during the densification of the molding material, to such an extent that no feedable connection exists any longer between the mold cavity and the feeder. For that reason, the preferred wall thickness of the tubular body depends on the type of material used.

Suitable wall thicknesses for the type of material chosen are known to those in the art or may be optimized by means of routine testing.

In a preferred embodiment hereof, the cutting process is supported insofar as the tubular body finds a stop and/or a contact surface in the feeder, as a result of which the tubular body is pressed, together with the feeder and/or the feeder head, towards the cast piece.

This support can be provided by a stop and/or a contact surface. In this context, the term "stop" refers to a special shape on a wall, in particular an interior wall, of the feeder and/or feeder head, which comes into contact, at least during the molding-on process and/or densification of the molding material, with a single point or a surface of the end of the tubular body facing away from the cast piece.

Of course, the tubular body may also be supported with respect to the feeder and/or feeder head by using a suitable glued, wedged, or fitted system between the tubular body and the feeder and/or feeder head, as already described, for example, in DE 100 59 481.6, or by a contact point or a contact surface which supports the tubular body with respect to the feeder and/or feeder head at least after the molding-on process and/or densification of the molding material.

In case a spring-supported pin is provided, prior to the molding-on process and/or densification of the molding material, the tubular body preferably does not rest on the leg of the spring-supported pin, but advances to the leg of the spring-supported pin as the molding material is densified. In accordance with this present invention, it is also possible that the tubular body, in case no spring-supported pin is provided, independently cuts and/or pushes itself to the cast piece and/or mold cavity.

It has been found that the feeder system in accordance with this present invention can be connected to and molded onto the casting molds in a very simple and universal manner, ensuring a reproducible and optimally positioned breaking edge, even in case a pin and/or spring-supported pin is used. After the molding process and, optionally, the removal of the core or (spring-supported) pin, the tubular body is left behind in the mold. The feeder system may be installed on the casting mold either in the plant or later on the client's premises.

Additionally, the feeder system in accordance with this present invention eliminates the need for other processes, such as the use of a commercially available breaking core, e.g. a Croning core, to produce a suitable breaking edge.

To the extent that the embodiments described herein also refer to the arrangement of the feeder and/or feeder head, the tubular body, the spring-supported and/or guiding pin, or the permanently positioned pin with respect to the cast piece and/or mold cavity, another aspect of this present invention also refers to a casting arrangement comprising the above defined feeder system and the cast piece/the mold cavity (and a molding material) and/or a method for preparing a casting mold by using the feeder system in accordance with this present invention.

Another aspect of this present invention refers to the use of a tubular body to form a feeder neck which can be molded thereonto comprising a breaking edge, for feeders for cast pieces.

DRAWINGS

This present invention shall be explained in more detail in the description below, which refers to the drawings attached hereto.

Figure 3A:
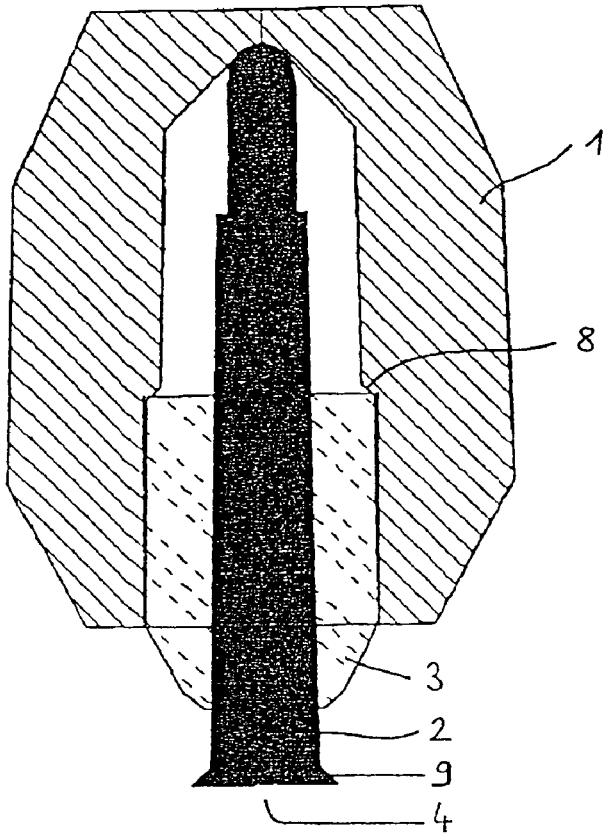
Figure 3B:
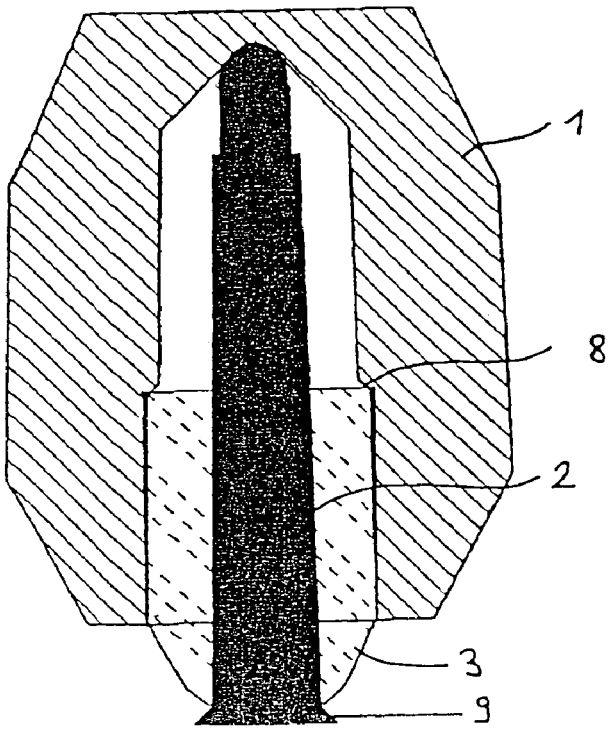
Figure 4A:
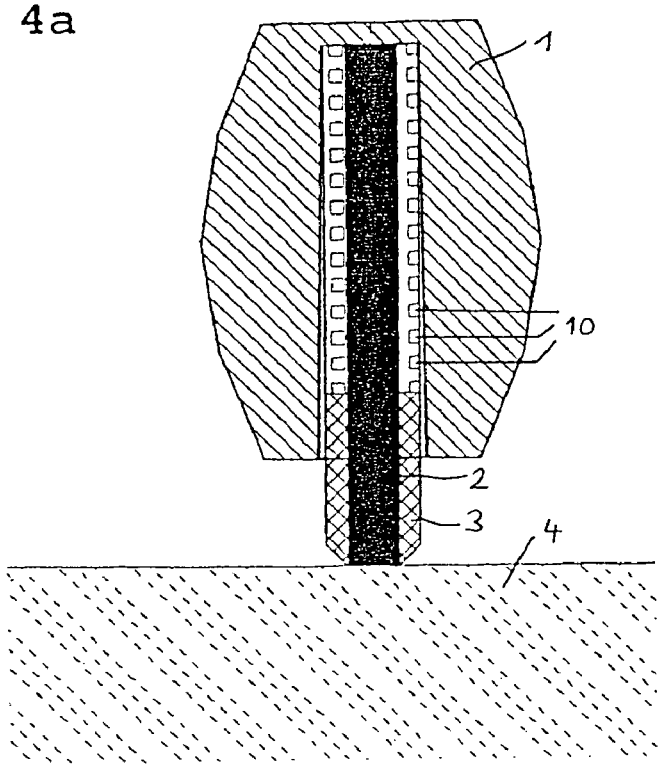
Figure 4B:
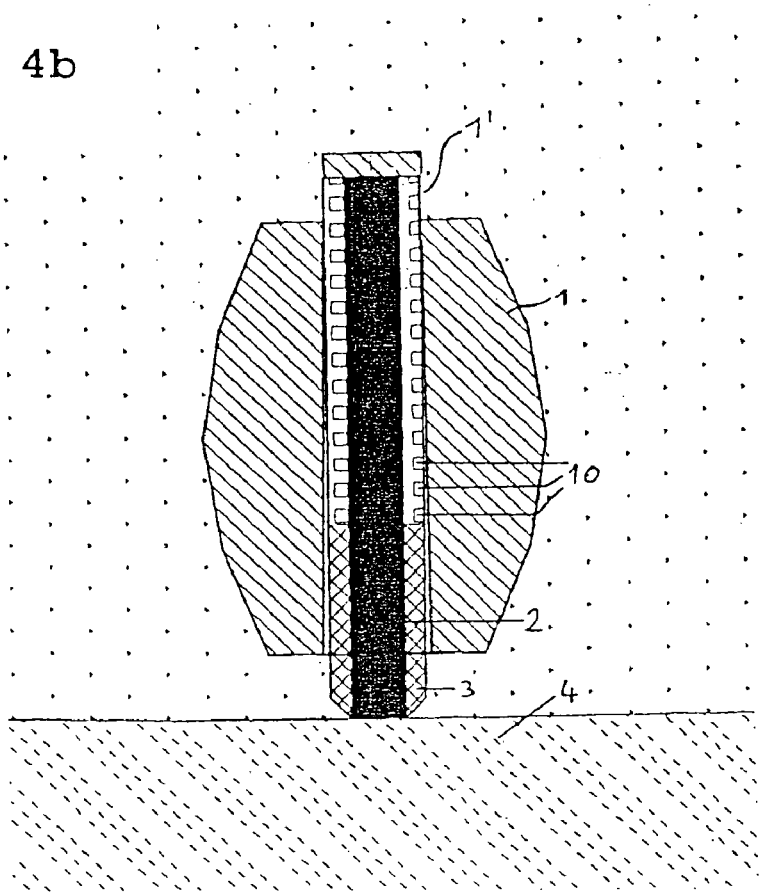
Figure 5:
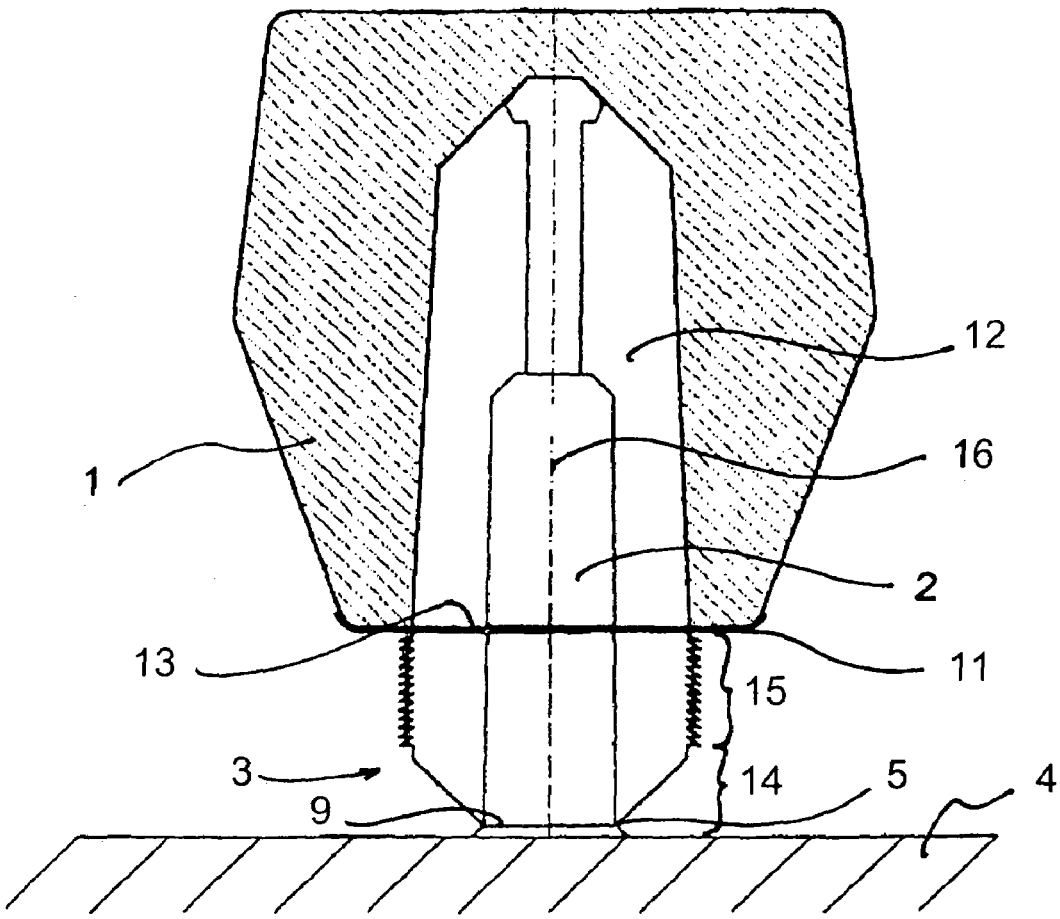
Figure 6:
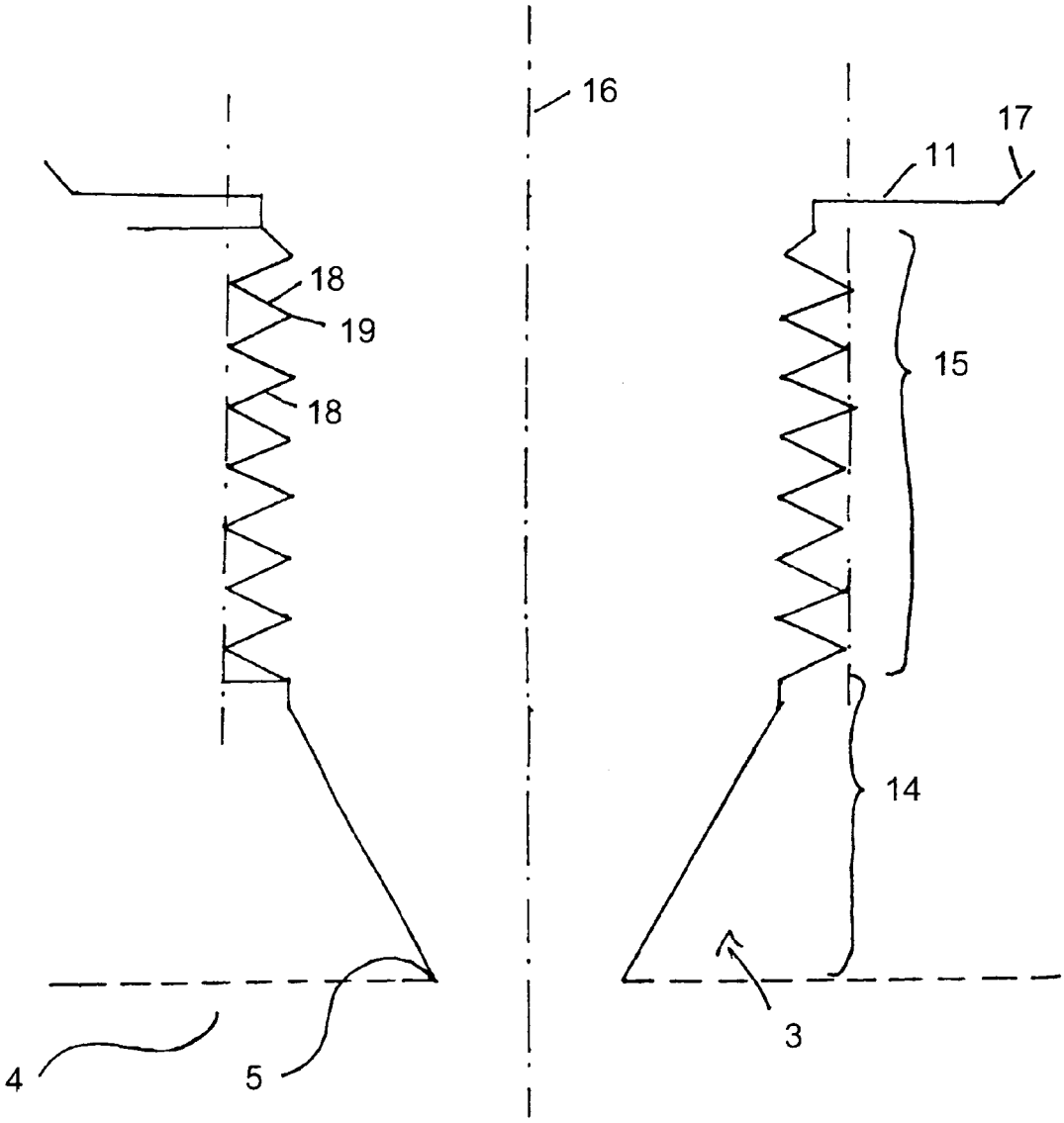
Figure 7:
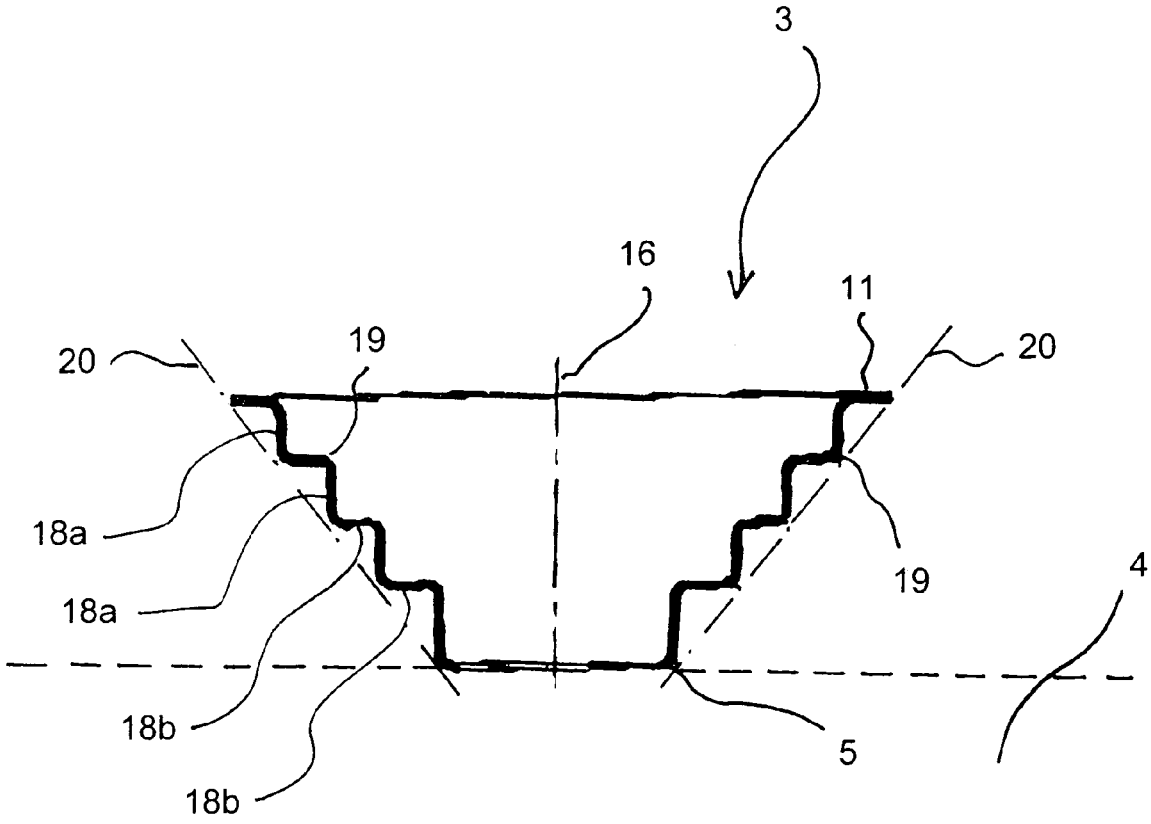

FIG. 3*a* shows a feeder system in accordance with this present invention with a tubular body prior to the molding process and/or the densification of the molding material;

FIG. 3*b* shows a feeder system in accordance with this present invention with a tubular body after the densification of the molding material;

FIGS. 4*a* and 4*b* show another embodiment of the feeder system in accordance with this present invention, wherein the tubular body has holes and/or openings in its part facing away from the cast piece;

FIG. 5 shows a feeder system in accordance with this present invention with a tubular body having a narrowing section which faces the cast piece, wherein the narrowing section has complementary inclined surfaces forming a harmonica-like section;

FIG. 6 shows the tubular body of the feeder system of FIG. 5 in more detail;

FIG. 7 shows a further embodiment of a tubular body of a feeder system in accordance with this present invention, wherein the tubular body has a narrowing section which faces the cast piece, wherein the narrowing section contains a series of perpendicular sections formed in a staircase-like form.

Figure 1:
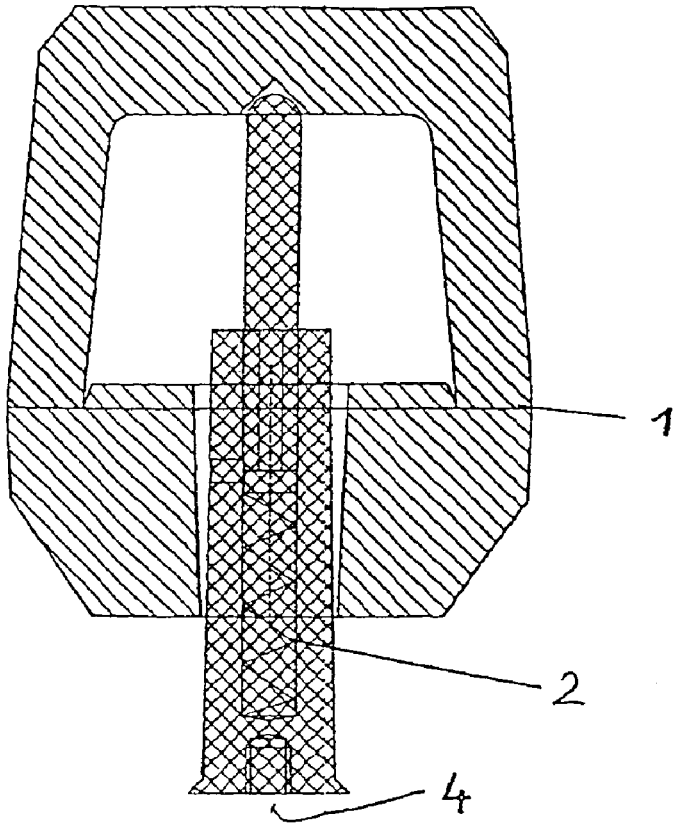
FIG. 1 shows a conventional feeder with a spring-supported pin.

FIG. 1 shows a conventional feeder 1 made from an exothermic and/or insulating material which has been placed on the cast piece 4 via a spring-supported pin 2. No optimal breaking edge is provided for separating and/or removing the remaining feeder.

Figure 2:
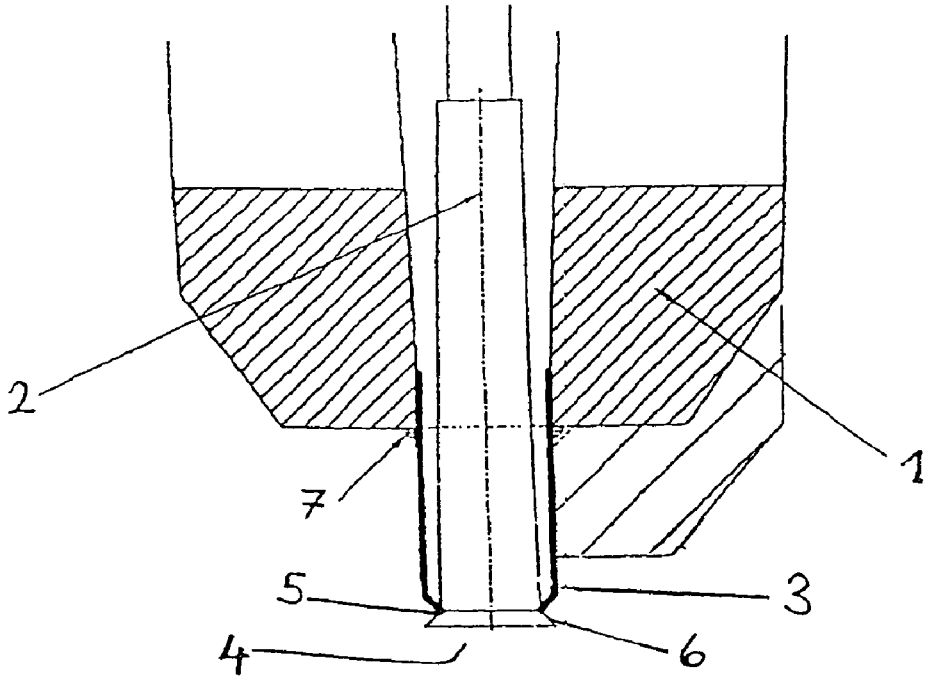
FIG. 2 shows a feeder system in accordance with this present invention with a tubular body, which narrows towards the cast piece.

FIG. 2 shows a feeder system in accordance with this present invention wherein, via the spring-supported pin 2, a tubular body 3 is guided which tapers off in the direction of the cast piece 4, providing a breaking edge 5. The tubular body tapers off towards the cast piece and rests on the leg and/or base 6 of the spring-supported pin. The tubular body 3 is either made of cardboard or of steel having a carbon content of at least about 0.7 wt.-% preferably at least about 1.5 wt-% with maximum amounts as discussed above. Onto the tube, a feeder (head) 1 had been placed, and to seal off the feeder and the circumference of the tube, a hot glue seam 7 is provided. Upon completion of the molding process, the feeder occupies the position indicated by the hatched lines; the relative movement occurs between the tubular body and the feeder, and the position of the breaking edge on the tubular body remains the same with respect to the cast piece. This ensures optimal positioning of the breaking edge regardless of the final post-molding position of the feeder.

FIG. 3 shows a feeder system in accordance with this present invention wherein, on the internal wall of the feeder (head) 1, a projection and/or a stop 8 is provided for the tubular body 3. The tubular body 3 tapers off in the direction of the cast piece and/or mold cavity 4 and can, during the molding-on process and/or the densification of the molding material, cut through the molding material and advance towards the cast piece.

As explained in more detail in the general description of this present invention, the spring path can be adjusted in such a manner during the densification of the molding material that the breaking edge forms on the leg of the pin 2 in the proximity of the cast piece. It is also possible that the tubular body does not have any narrowing and is essentially cylindrical.

FIG. 3*a* shows the feeder system prior to the densification of the molding material, and the end of the tubular body facing the cast piece does not rest on the leg 9 of the spring-supported pin and/or is directly connected with the cast piece or the mold cavity.

FIG. 3*b* shows the feeder system after the densification of the molding material, and the tubular body is directly connected with mold cavity and/or rests on the leg 9 of the spring-supported pin 2, if available, or the cast piece.

FIGS. 4*a* and 4*b* show yet another embodiment of the feeder system in accordance with this present invention, wherein the tubular body 3 has holes and/or openings 10 in its part facing away from the cast piece. In the embodiment shown here, the tubular body rests on the cast piece 4 already prior to the molding-on process and/or the densification of the molding material. After the molding-on process and/or the densification of the molding material (FIG. 4*b*), the feeder head 1 was deliberately destroyed in the upper section 1', causing a relative movement between the tubular body 3 and the feeder head 1.

FIG. 5 shows a feeder system in accordance with the invention. On a cast piece 4 is mounted a spring-supported pin 2 via which a tubular body 3 is guided which tapers off in the direction towards the cast piece 4 to form a breaking edge 5. Onto tubular body 3, a feeder head 1 is placed which rests on a projection 11 of the tubular body 3. Feeder head 1 comprises a hollow space 12 which is connected to the tubular body 3 via an opening 13. The tubular body 3 rests on leg 9 of spring-supported pin 2. The tubular body 3 is divided into two sections, a section 14, in which the tubular body tapers towards the cast piece 4, and a narrowing section 15 that has complementary inclined surfaces 18 formed in a harmonica- like structure. During densification of a molding material feeder head 1 moves along axis 16 in the direction towards casting piece 4. By the movement of feeder head 1, the harmonica-like structure 15 of the tubular body 3 is compressed such that the feeder head is not destroyed by the pressure applied for densification of the molding material.

FIG. 6 displays the tubular body 3 of the feeder system of FIG. 5 in more detail showing the narrowing section 15. The tubular body 3 comprises the tapered section 14 and the narrowing section 15 having the complementary inclined surfaces 18 formed in a harmonica-like structure. At the end of tubular body 3 facing away from the casting peace is provided a projection 11 on which a feeder head 1 (not shown) may be rested. At the outer circumference of projection 11, an edge 17 is provided for centering the feeder head along axis 16. The narrowing section 15, formed in a harmonica like structure, comprises segments 18 which are situated in complementary arrangement to each other in inclined angles. Between the individual segments 18, a knick 19 is provided. When applying pressure onto tubular body 3 along axis 16, the complementary inclined surfaces of the harmonica-like section 15 are compressed by folding segments 18 along knicks 19. The deformation of the complementary inclined surfaces of the harmonica-like section 15 therefore occurs in a controlled manner permitting the tapered section 14 to remain stable in its original form, thereby providing a breaking edge 5 in a defined position close to the cast piece 4.

FIG. 7 shows another embodiment of tubular body 3 for use in a feeder system according to the invention. The tubular body 3 comprises segments 18*a* arranged parallel to axis 16 as well as segments 18*b* being arranged perpendicular to axis 16. Segments 18*a* and 18*b* therefore are arranged perpendicular to each other with a knick 19 provided between each pair of segments. The tubular body 3 comprises a projection 11 onto which a feeder head 1 (not shown) is rested. The outer surface of tubular body 3 tapers along dashed line 20 to provide a breaking edge 5 at the lower end of tubular body 3 in close proximity to cast piece 4. During densification of a molding material tubular body 3 may be deformed in a controlled manner by deforming the tubular body 3 at knick 19.

The tubular bodies 3 shown in FIGS. 5, 6 and 7 may be made of cardboard or steel having a carbon content of at least about 0.7 weight percent, preferably at least about 1.5 weight percent with a maximum carbon content of about 8 weight percent, preferably 5 weight percent and most preferably 4 weight percent.

The invention claimed is:

1. A feeder system connected with a cast piece, comprising:

a first part, facing away from the cast piece, comprising a feeder or a feeder head which comprises a cavity to receive liquid metal during a casting process; and a second part, facing towards the cast piece, comprising a tubular body, which connects the cavity in the feeder or feeder head to a cavity of the cast piece, wherein the composition of the tubular body comprises cardboard; and wherein the tubular body narrows in cross section of internal diameter towards its end facing the cast piece of mold cavity to thereby contribute to the formation of a breaking edge in the tubular body.

2. The feeder system according to claim 1, wherein the wall thickness of the tubular body is more than about 0.5 mm.

3. The feeder system according to claim 1, wherein the cardboard has a weight of at least about 200 g/m$^2$.

4. The feeder system according to claim 1, wherein the cardboard is solid cardboard.

5. The feeder system according to claim 1, wherein the tubular body has an essentially uniform diameter and an essentially cylindrical or cylindrical shape.

6. The feeder system of claim 1, wherein during a molding-on process or during densification of the molding material, the tubular body essentially does not move with respect to the cast piece and the feeder or feeder head does move with respect to the cast piece.

7. The feeder system of claim 6, further comprising a spring-supported pin or guiding pin, wherein the tubular body is at least partially pushed over one of said pins.

8. The feeder system of claim 7, wherein the feeder or feeder head, the tubular body, and the spring-supported pin or guiding pin are sized such that, after the molding-on process or densification of the molding material, the tubular body forms the breaking edge on a side facing the cast piece and the feeder or feeder head does not directly rest on the cast piece.

9. The feeder system of claim 7, wherein the tubular body, after the molding-on process or densification of the molding material, rests on a leg of the spring-supported or guiding pin, thereby forming the breaking edge in the proximity of the cast piece.

10. The feeder system of claim 7, wherein the tubular body further comprises a permanently positioned pin provided to center the tubular body.

11. The feeder system of claim 10, wherein the length of the permanently positioned pin does not exceed that of the tubular body and the tubular body is at least partially pushed over the permanently positioned pin.

12. A moldable feeder neck for feeders for cast pieces comprising the feeder system of claim 1.

13. A process for casting comprising preparing the feeder system of claim 1, preparing a cast piece or mold cavity and a molding material and installing the feeder system to the cast piece or mold cavity prior to the molding-on or densification of the molding material.

14. The feeder system of claim 1, wherein the tubular body further comprises a narrowing section arranged with a knick situated between individual segments of the narrowing section.

15. The feeder system of claim 14, wherein the individual segments of the narrowing section of the tubular body comprise complimentary inclined surfaces formed together in a harmonica-like form.

16. The feeder system of claim 14, wherein individual segments of the narrowing section of the tubular body which narrow in a direction towards the cast piece comprise perpendicular segments formed together in a stepwise shape.

17. A feeder system connected with a cast piece, comprising:

a first part, facing away from the cast piece, comprising a feeder or a feeder head which comprises a cavity to receive liquid metal during a casting process; and a second part, facing towards the cast piece, comprising a tubular body, which connects the cavity in the feeder or feeder head to a cavity of the cast piece, wherein the composition of the tubular body comprises steel, said steel having a carbon content of at least about 0.7 wt.-%.

18. The feeder system of claim 17, wherein the carbon content of the steel is from about 1.5 wt.-% to about 8 weight percent.

19. The feeder system according to claim 17, wherein the tubular body narrows in cross section of internal diameter towards its end facing the cast piece or mold cavity to thereby contribute to the formation of a breaking edge in the tubular body.

20. The feeder system of claim 17, wherein the tubular body has an essentially uniform diameter and an essentially cylindrical or cylindrical shape.

21. The feeder system of claim 17, wherein the feeder or feeder head comprises a stop or a contact surface and the tubular body abuts at the stop or contact surface with its end facing away from the cast piece or mold cavity.

22. The feeder system of claim 21, wherein the stop or contact surface is formed as a projection on an inside surface of the feeder or feeder head.

23. The feeder system of claim 21, wherein the stop or contact surface is formed as two or more contact points or an annular contact surface.

24. The feeder system of claim 21, wherein the stop or contact surface is located on a lateral interior wall or an upper interior wall of the feeder or feeder head and the tubular member is at least partially inserted into the feeder or feeder head.

25. The feeder system of claim 17, wherein the tubular body further comprises a thin wall such that the tubular body can cut or push itself through to the cast piece during a molding-on process or during densification of the molding material.

26. The feeder system of claim 17, wherein during a molding-on process or during densification of the molding material, the tubular body essentially does not move with respect to the cast piece or mold cavity, and the feeder or feeder head does move with respect to the cast piece or mold cavity.

27. The feeder system of claim 17, wherein during a molding-on process or during densification of the molding material, the tubular body essentially does not move with respect to the feeder or feeder head, but does move with respect to the cast piece or mold cavity.

28. The feeder system of claim 17, further comprising a spring-supported pin or guiding pin, wherein the tubular body is at least partially pushed over one of said pins.

29. The feeder system of claim 28, wherein the tubular body, prior to the molding-on process or during densification of the molding material, does not rest with its side facing the cast piece or mold cavity on the mold or spring-supported or guiding pin.

30. The feeder system of claim 28, wherein the feeder or feeder head, the tubular body, and the spring-supported pin or guiding pin are sized such that, after the molding-on process or densification of the molding material, the tubular body forms the breaking edge on a side facing the cast piece and the feeder or feeder head does not directly rest on the cast piece or mold cavity.

31. The feeder system of claim 28, wherein the tubular body, after the molding-on process or densification of the molding material, rests on a leg of the spring-supported or guiding pin, thereby forming the breaking edge in the proximity of the cast piece.

32. The feeder system of claim 17, wherein the tubular body further comprises a permanently positioned pin provided to center the tubular body.

33. The feeder system of claim 32, wherein the length of the permanently positioned pin does not exceed that of the tubular body and the tubular body is at least partially pushed over the permanently positioned pin.

34. A moldable feeder neck for feeders for cast pieces comprising the feeder system of claim 17.

35. A process for casting comprising preparing the feeder system of claim 17, preparing a cast piece or mold cavity and a molding material and installing the feeder system to the cast piece or mold cavity prior to the molding-on or densification of the molding material.

36. A process for casting comprising preparing the feeder system of claim 17, preparing a cast piece or mold cavity and, without directly connecting the feeder system to the cast piece or mold cavity, resting the feeder system on the cast piece or mold cavity such that a pin of the feeder system rests on the cast piece or mold cavity or the feeder system cuts through to the cast piece during densification of the molding material.

37. The feeder system of claim 17, wherein the tubular body further comprises a narrowing section arranged with a knick situated between individual segments of the narrowing section.

38. The feeder system of claim 37, wherein the individual segments of the narrowing section of the tubular body comprise complimentary inclined surfaces formed together in a harmonica-like form.

39. The feeder system of claim 37, wherein individual segments of the narrowing section of the tubular body which narrow in a direction towards the cast piece comprise perpendicular segments formed together in a stepwise shape.

40. A feeder system connected with a cast piece or a mold cavity, said feeder system comprising at least two parts a first part, situated at a side facing away from the cast piece, forming a feeder or a feeder head which comprises a cavity to receive liquid metal during a casting process, said cavity being closed at its end facing away from the cast piece;

a second part, situated at the side facing towards the cast piece, which is formed by a tubular body, which connects the cavity formed by the feeder or feeder head to the cavity of the cast piece, wherein the tubular body narrows in cross section or internal diameter towards its end facing the cast piece or mold cavity;

wherein the composition of the tubular body comprises steel; wherein said steel has a carbon content of at least about 0.7 wt. %; and wherein the tubular body is at least partially inserted into the cavity of the feeder or feeder head such that the tubular body with its end facing away from the cast piece or mold cavity abuts at the upper end of the cavity of the feeder or feeder head such that after the molding on process or the densification of the molding material, the feeder head is destroyed in its upper section, causing a relative movement between the tubular body and the feeder head.

41. The feeder system of claim 40, wherein the tubular body has holes or openings facing away from the cast piece.

* * * * *